US008371375B2

(12) United States Patent
Garr et al.

(10) Patent No.: US 8,371,375 B2
(45) Date of Patent: Feb. 12, 2013

(54) WIRELINE RUN MECHANICALLY OR HYDRAULICALLY OPERATED SUBTERRANEAN INSERT BARRIER VALVE AND ASSOCIATED LANDING NIPPLE

(75) Inventors: Ronald J. Garr, Inola, OK (US); Kevin R. Plunkett, Coweta, OK (US)

(73) Assignee: Baker Hughes Incorporated, Houston, TX (US)

( * ) Notice: Subject to any disclaimer, the term of this patent is extended or adjusted under 35 U.S.C. 154(b) by 550 days.

(21) Appl. No.: 12/634,524

(22) Filed: Dec. 9, 2009

(65) Prior Publication Data

US 2011/0132614 A1 Jun. 9, 2011

(51) Int. Cl.
*E21B 34/06* (2006.01)

(52) U.S. Cl. ..... 166/242.6; 166/332.4

(58) Field of Classification Search ..... 166/72, 166/324, 332.4, 332.5, 242.6
See application file for complete search history.

(56) References Cited

U.S. PATENT DOCUMENTS 3,826,462 A * 7/1974 Taylor ..... 251/58
3,853,175 A 12/1974 Boyadjieff et al.
3,999,574 A * 12/1976 Ott ..... 137/629
4,103,744 A * 8/1978 Akkerman ..... 166/324
4,149,698 A * 4/1979 Deaton ..... 251/63.6
4,215,748 A * 8/1980 Pace et al. ..... 166/322
4,418,750 A 12/1983 Paschal, Jr.
4,448,216 A 5/1984 Speegle et al.
4,452,311 A 6/1984 Speegle et al.
4,524,830 A 6/1985 Williams
4,605,070 A 8/1986 Morris
5,496,044 A 3/1996 Beall et al.
5,862,865 A 1/1999 Murray et al.
2008/0110632 A1 5/2008 Beall
2010/0200220 A1* 8/2010 Beall et al. ..... 166/206

* cited by examiner

*Primary Examiner* — Daniel P Stephenson
(74) *Attorney, Agent, or Firm* — Steve Rosenblatt

(57) ABSTRACT

A unique landing nipple has spaced control line connections and external control lines running from the surface to those connections. A hydraulic barrier valve, such as a ball valve, is run in to a predetermined landing nipple and latched in position where the control line connections are in the right locations to operate the valve. A landing nipple with a latching groove alone can be used with a wireline run barrier valve to latch it into position at the desired location. A shifting tool is used to operate the mechanically actuated valve. More than one valve can be positioned or used in the string at a time or the same valve can also be positioned at different landing nipples at different times to meet the production needs of the well operator.

20 Claims, 3 Drawing Sheets

WIRELINE RUN MECHANICALLY OR HYDRAULICALLY OPERATED SUBTERRANEAN INSERT BARRIER VALVE AND ASSOCIATED LANDING NIPPLE

FIELD OF THE INVENTION

The field of the invention is barrier valves for subterranean use and more particularly such valves that can be run in on wireline and latch to a specific landing nipple and which can be subsequently operated mechanically or hydraulically.

BACKGROUND OF THE INVENTION

String mounted barrier valves are made up with a string when the string is run into a subterranean location. If the valve is hydraulically operated such as with one or more control lines, the control lines are made up and run outside the tubular string until the valve is at its proper location. Barrier valves isolate one part of the wellbore from another against flow in either direction. One type of such hydraulically actuated barrier valve that is run in as part of a string is illustrated in US Publication 20080110632. Insert safety valves can be run into a string and latch into a landing nipple with dogs that extend for support off the existing safety valve where the insert valve runs off a control system of the initial safety valve as illustrated in U.S. Pat. No. 5,862,865. U.S. Pat. No. 5,496,044 illustrates an annular chamber in a safety valve in a string that is penetrated by a penetrating tool and an insert safety valve is run into the string mounted safety valve and pressure in the penetrated annular chamber communicates to the insert safety valve to subsequently operate it.

There are applications where barrier valves are not initially needed and could be needed in the future. It is economical in these situations for the well operator to delay the purchase of such expensive items as barrier valves until the time they are actually needed downhole. The present invention allows such flexibility by providing a valve that can be run into a predetermined location or locations and latched into position. These locations are landing nipples that have been put into the string initially at desired locations. Preferably they have unique patterns for a valve latching system to engage only on a desired landing nipple that matches the profile of the latch mechanism that mates with it and is mounted on the barrier valve that is preferably run into the wellbore on wireline. In the case of a hydraulically operated barrier valve, the landing nipple or nipples in the string will already have control lines initially installed with the string in a landing nipple or nipples. The barrier valve hydraulic connections are lined up and in a sealing relation to the control line connections in the landing nipple so that the barrier valve can latch in and immediately be operated hydraulically with the control lines. Alternatively, a wireline tool can be run in to open communication to the landing nipple before the barrier valve is run in. These and other aspect of the present invention will be more readily appreciated by those skilled in the art from a review of the attached specification and drawings while appreciating that the full scope of the invention is determined by the appended claims.

SUMMARY OF THE INVENTION

A unique landing nipple has spaced control line connections and external control lines running from the surface to those connections. A hydraulic barrier valve, such as a ball valve, is run in to a predetermined landing nipple and latched in position where the control line connections are in the right locations to operate the valve. A landing nipple with a latching groove alone can be used with a wireline run barrier valve to latch it into position at the desired location. A shifting tool is used to operate the mechanically actuated valve. More than one valve can be positioned or used in the string at a time or the same valve can also be positioned at different landing nipples at different times to meet the production needs of the well operator.

DETAILED DESCRIPTION OF THE PREFERRED EMBODIMENT

Figure 1:
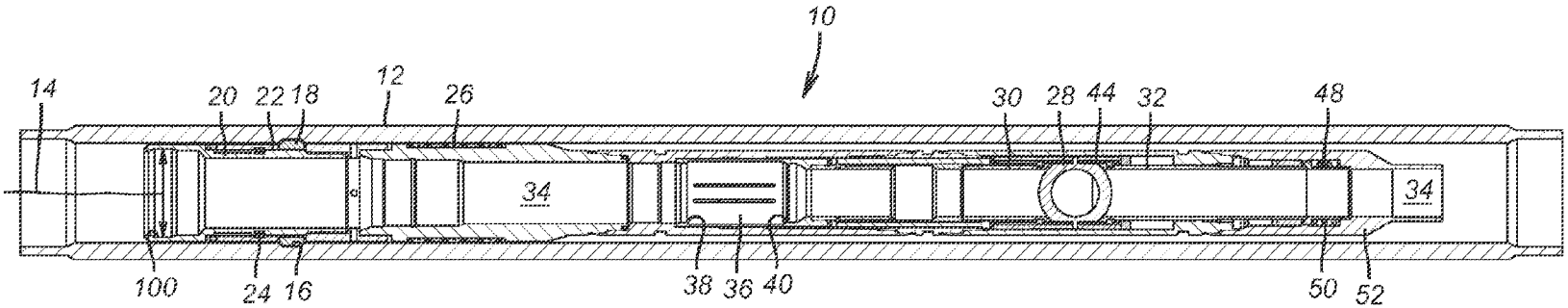
FIG. 1 shows a mechanically operated barrier valve landed in its associated landing nipple and locked to it.
Figure 2:
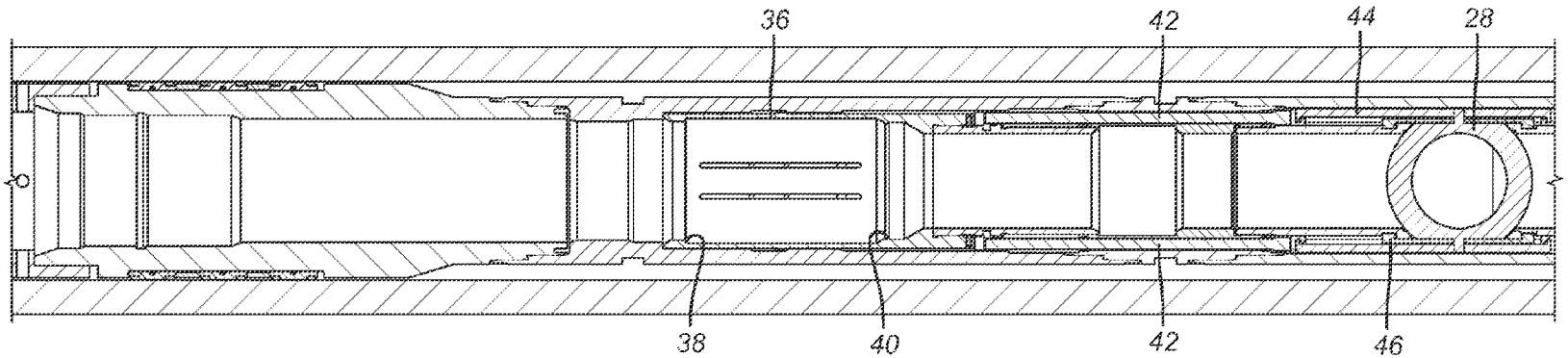
FIG. 2 is a close up view of the mechanically operated valve of FIG. 1.
Figure 3:
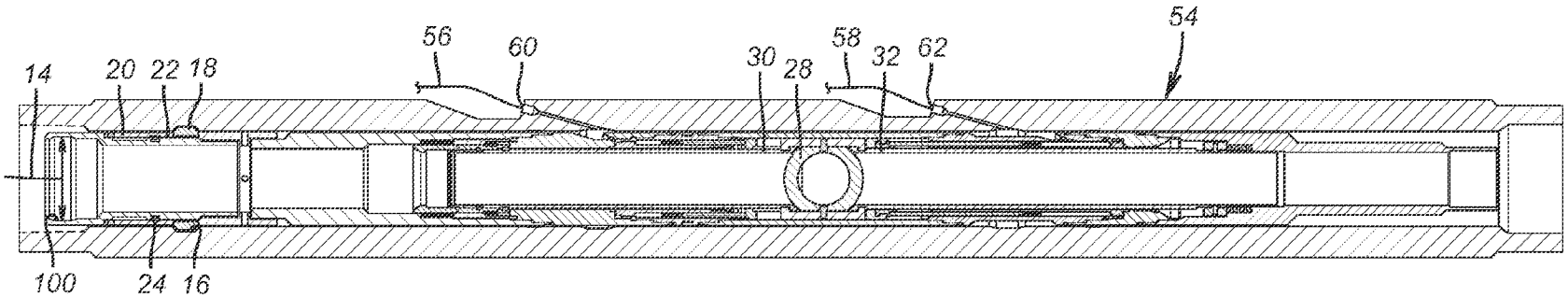
FIG. 3 shows a hydraulically operated valve and associated landing nipple locked together.
Figure 4:
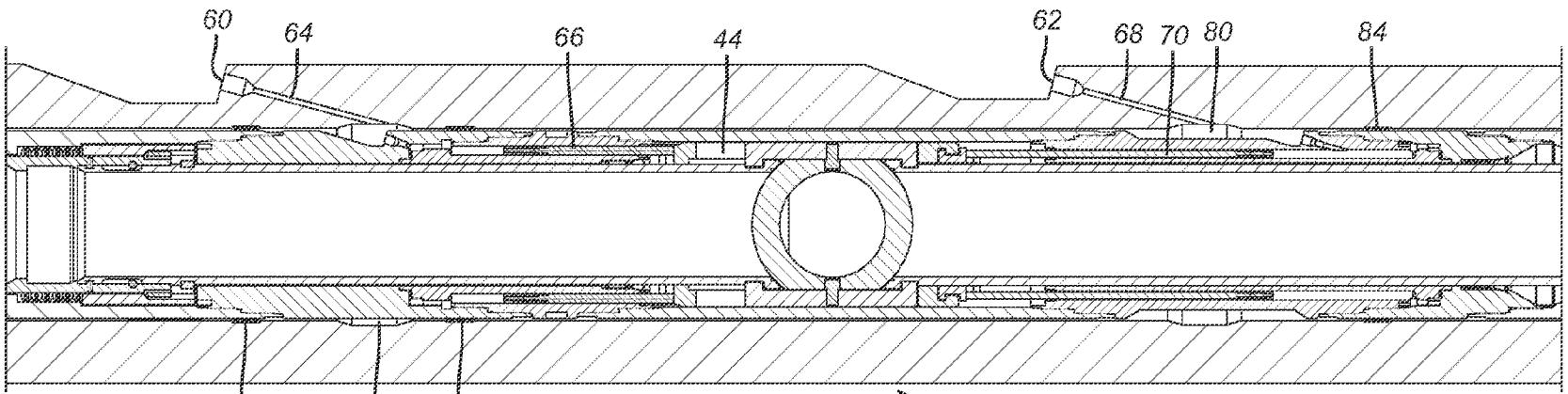
FIG. 4 is a close up view of the valve shown in FIG. 3.
Figure 5:
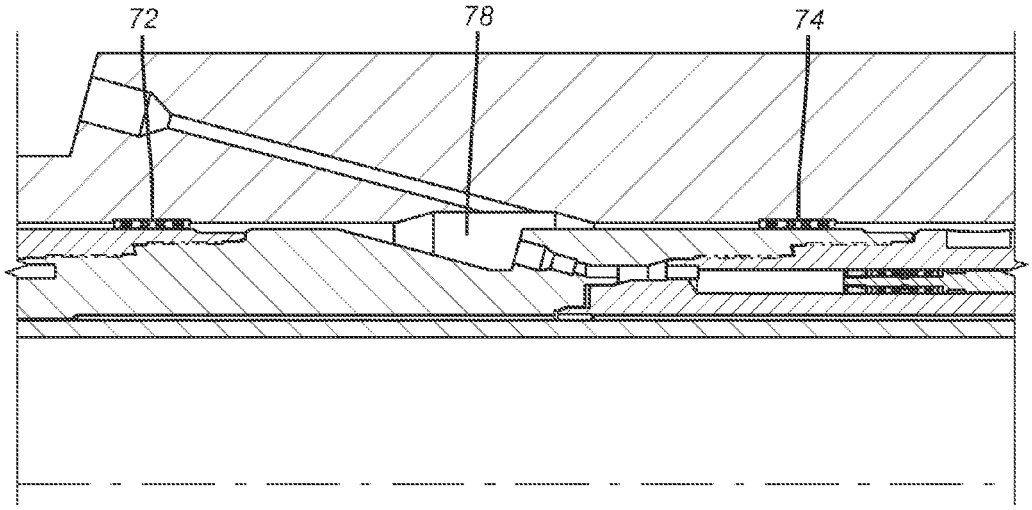
FIG. 5 is a close up view at the upper control line connection of the landing nipple and how the landed valve takes pressure from the connection to its operating piston.
Figure 6:
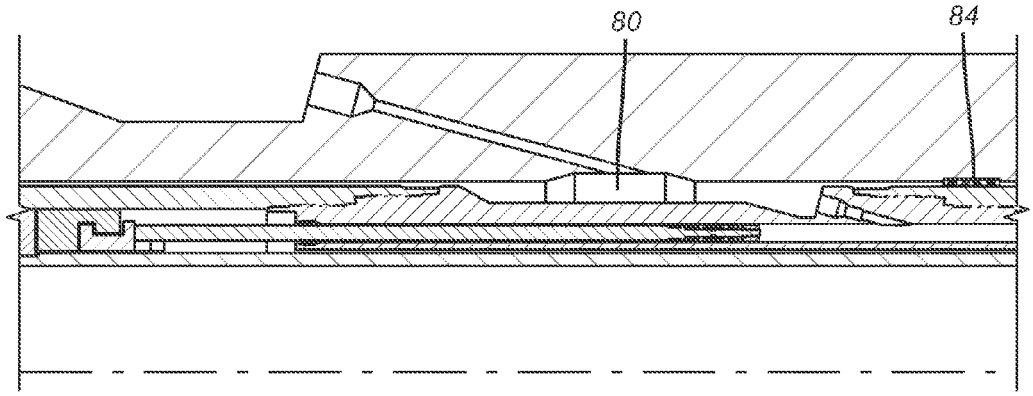
FIG. 6 is the view of FIG. 5 except at a lower control line connection.

FIG. 1 illustrates a mechanically operated barrier valve 10 that is delivered through a string (not shown) into a landing nipple 12 by a wireline 14 that is schematically illustrated. A groove 16 is located in the nipple 12 so that when the valve 10 no goes in the nipple 12 the dogs 18 will line up with the groove 16 and a sleeve 20 can be shifted to back up the dogs 18 into the groove 16 for support of the valve 10. The schematically illustrated wireline 14 can include a jar tool that shifts sleeve 20 into the FIG. 1 position to put surface 22 behind the dogs 18 so that they are firmly supported in the groove 16. A snap ring 24 can snap into a groove in the sleeve 20 after sleeve 20 is shifted so as to retain the locked FIG. 1 position of sleeve 20. Valve 10 is sealed on its exterior to the landing nipple 12 by a seal assembly 26.

In the preferred embodiment, valve 10 is a barrier valve that has a ball 28 between seat sleeves 30 and 32. A through passage 34 runs through valve 10 through sleeves 30 and 32 and ball 28, shown in FIG. 1 in the closed position. An operating sleeve 36 has opposed shoulders 38 and 40. A shifting tool opens the ball 28 by pushing down on shoulder 40 and closes ball 28 by picking up on shoulder 38. The shifting tool is not shown for clarity for the remaining details but can be of a type that is known in the art. Sleeve 36 is connected to one or more connecting rods 42 that are in turn connected to a slide assembly 44. Ball cage 44 has an eccentric connection to ball 28 such that translation of the slide assembly 44 rotates the ball 28 on its own axis. Sleeves 30 and 32 do not move but they maintain a seal on the ball as ball 28 rotates on its own axis. The seats on sleeves 30 and 32 are held against the ball 28 by spring 50 as it is rotated 90 degrees in opposed directions by shifting of sleeve 36. Sleeve 48, biased by spring 50, compensates for dimensional tolerances on makeup of the assembly as bottom sub 52 is put on. A downhole tool or tools (not shown) can be connected to bottom sub 52.

FIGS. 3-6 illustrate a hydraulically operated embodiment that latches to a landing nipple 54 using a groove 18 as the latching technique and delivery on wireline is the same as shown in FIG. 1. The valve components are similar as far as the ball 28 surrounded by seat sleeves 30 and 32. In this embodiment the ball 28 responds to pressure delivered through control lines 56 or 58 that are connected to connections 60 and 62 on the landing nipple 54. Connection 60 leads to a passage 64 that communicates to a piston assembly 66 that pushes on the slide assembly 44 which is the same as in the FIG. 1 embodiment. On the opposite end of slide assembly 44 is a passage 68 that leads to a piston 70 connected on an opposite side of slide assembly 44 than piston 66. Seals 72 and 74 carried by the valve 76 straddle annular chamber 78 so that delivering the valve 76 on wireline 14 and latching it to the landing nipple 54 at groove 16 with dogs 18 allows pressure in control line 56 to be communicated against piston assembly 66 (which can be one or more pistons) for movement of the ball 28 in a first direction while pressure delivered in line 58 goes through passage 68 to chamber 80 that is isolated by seals 74 and 84 carried on the valve 76 so that pressure in line 58 moves piston assembly 70 (which can be one or more pistons) in an opposed direction to piston assembly 66 to return the ball 28 to a second position which preferably is the closed position shown in FIG. 4. The various seals for the chambers 78 and 80 are more easily seen in FIGS. 5 and 6.

Those skilled in the art will appreciate that a landing nipple 54 can be installed within a string with hydraulic lines connected to it at 60 and 64 without a valve 76 being in position until it is later needed. One or more such landing nipples 54 can be installed in a string with different engaging profiles 16 so that more than one valve at a time can be run in with a wireline 14 and landed in the location where the dog assembly 18 matches the profile 16. While a wireline 14 is illustrated, other forms of conveyance of the valve 10 or 76 are envisioned such as coiled tubing or rigid tubing, for example. While the seals for chambers 78 and 80 can be on the valve 76 and abut a seal bore in the landing nipple 54 they can also be located on the landing nipple 54 as an alternative. Alternatively, connections 60 and 62 can be used for other functions than hydraulic lines. Signal and power lines can be connected at those locations such as wires or fiber optic cable. In those instances the valve 76 can have the opposite end of a connection that mates with a connection on the inside of the landing nipple 54 simply by insertion and locking the valve 76 into position. In those instances the landing nipple can also have tapered guide surfaces to ensure proper orientation of the valve 76 when in locks into groove 16 with dogs 18. The pattern of groove 16 can be a unique pattern in a string where there is more than one landing nipple 54 and the dog pattern on a particular valve can match only one pattern to ensure the intended valve 76 lands in the desired landing nipple 54. While the valve 76 is illustrated as a ball valve that is hydraulically operated with opposed piston assemblies 66 and assemblies 70 the valve type can vary as can the nature of the hydraulic system that actuates it. For example, valve 76 can be a choke or a sliding sleeve or a plug valve or the device need not even be an isolation valve of any type and can be other downhole tools that operate with hydraulic pressure. Such devices can also operate off a single control line with a pressurized onboard reservoir or spring to push in opposed direction than the action created by application of control line pressure.

The landing nipple 54 when used alone in a string with the lines 56 and 58 run in at the same time allows the later rapid insertion of a tool such as a barrier valve to be run in only when needed. This allows the operator to save money by running a simpler string and not purchasing the expensive tool until it is determined that it is absolutely needed. The tool could also be removed for repair, redress, or reconfiguration of the string without removing the entire string. The modular style tools that can be run in and locked into position also allow for rapid deployment and avoidance of the expense of installation until the actual need arises. Such drop in tools as barrier valves can be rapidly deployed by wireline or slickline or other conveyance modes as mentioned above and quickly locked into position with an accessory tool to create relative movement to support the dogs 18 in groove 16.

The barrier valve 10 can also be simply operated with a shifting tool (not shown) pushing on shoulder 40 or pulling on shoulder 38. This tool can merely shift sleeve 36 for the open and closed positions of ball 28 and it can also be configured to deliver the valve such as 10 or later retrieve it. On the subject of retrieval it should be noted that fishing neck 100 can be grabbed by a running or fishing tool to pull sleeve 20 by breaking a securing device such as a shear pin that allows sleeve 20 to shift so as to remove support for dogs 18 so that the valve 10 can be removed when no longer needed. Valve 76 or other downhole tools delivered in this manner can be removed as just described.

The above description is illustrative of the preferred embodiment and various alternatives and is not intended to embody the broadest scope of the invention, which is determined from the claims appended below, and properly given their full scope literally and equivalently.

We claim:

1. An assembly of a subterranean tool insertable into a landing nipple on a string, comprising:

at least one landing nipple at a subterranean location on the string;

at least one tool run in from a surface into said landing nipple for support thereof, said tool subsequently operable through said string or said landing nipple;

said landing nipple rotationally orients said tool as said tool moves toward a supported position in said landing nipple for subsequent operation thereof.

2. The assembly of claim 1, wherein:

said tool comprises a barrier valve to isolate against flow in opposed directions.

3. The assembly of claim 2, further comprising:

a wireline support for delivery of said valve to said landing nipple.

4. The assembly of claim 3, wherein:

said valve comprises at least one external seal to seal against said landing nipple when said valve is supported in said landing nipple.

5. The assembly of claim 3, wherein:

said landing nipple comprises at least one internal seal or seal bore to seal against said valve when said valve is supported in said landing nipple.

6. The assembly of claim 2, wherein:

said valve is operable through pressure delivered to at least one connection on said landing nipple.

7. The assembly of claim 6, wherein:

said landing nipple further comprises at least two connections with hydraulic lines extending from said connections to the surface;

said valve in fluid communication with said connections when inserted to a supported position in said landing nipple.

8. The assembly of claim 7, wherein:

said valve is in sealed fluid communication with said connections by virtue of seals on one of said valve and said landing nipple that straddle said connections.

9. The assembly of claim 7, wherein:

said valve defining an annular chamber at each of said connections with said landing nipple when said valve is in a supported position on said landing nipple.

10. The assembly of claim 9, wherein:

said annular chambers respectively lead to pistons which are operably connected to a valve member to move it between an open and a closed position in response to applied pressure to one or the other of said chambers.

11. The assembly of claim 2, wherein:

said landing nipple comprising a uniquely configured locking groove selectively engaged by at least one dog on said valve after said valve is in a supported position on said landing nipple.

12. The assembly of claim 11, wherein:

said valve comprises a sleeve that shifts to support said dog in said groove to lock said valve to said landing nipple.

13. The assembly of claim 2, wherein:

said landing nipple comprises at least one connection with a line running to said connection from the surface;

said valve operably engages said connection when supported in said landing nipple.

14. The assembly of claim 2, wherein:

said valve comprises a shifting sleeve accessible from the string and operably connected to a valve member for operating said valve member with said sleeve between an open and a closed position.

15. An assembly of a subterranean tool insertable into a landing nipple on a string, comprising:

at least one landing nipple at a subterranean location on the string;

at least one tool run in from a surface into said landing nipple for support thereof, said tool subsequently operable through said string or said landing nipple;

said tool comprises a barrier valve to isolate against flow in opposed directions;

said valve is mechanically operated through an actuation tool delivered into the string.

16. An assembly of a subterranean tool insertable into a landing nipple on a string, comprising:

at least one landing nipple at a subterranean location on the string;

at least one tool run in from a surface into said landing nipple for support thereof, said tool subsequently operable through said string or said landing nipple;

said tool comprises a barrier valve to isolate against flow in opposed directions;

a wireline support for delivery of said valve to said landing nipple;

said landing nipple comprising a uniquely configured locking groove selectively engaged by at least one dog on said valve after said valve is in a supported position on said landing nipple;

said valve comprises a sleeve that shifts to support said dog in said groove to lock said valve to said landing nipple;

said wireline further comprises a device to shift said sleeve to lock said dog.

17. An assembly of a subterranean tool insertable into a landing nipple on a string, comprising:

at least one landing nipple at a subterranean location on the string;

at least one tool run in from a surface into said landing nipple for support thereof, said tool subsequently operable through said string or said landing nipple;

said tool comprises a barrier valve to isolate against flow in opposed directions;

said valve is operable through pressure delivered to at least one connection on said landing nipple;

said valve comprises a sleeve that shifts to support said dog in said groove to lock said valve to said landing nipple;

said sleeve further comprises a fishing neck for application of a release force to remove support for said dog to allow retrieval of said valve from said string.

18. An assembly of a subterranean tool insertable into a landing nipple on a string, comprising:

at least one landing nipple at a subterranean location on the string;

at least one tool run in from a surface into said landing nipple for support thereof, said tool subsequently operable through said string or said landing nipple;

said tool comprises a barrier valve to isolate against flow in opposed directions;

said landing nipple comprising a uniquely configured locking groove selectively engaged by at least one dog on said valve after said valve is in a supported position on said landing nipple;

said at least one landing nipple comprises a plurality of axially spaced landing nipples on said string with each landing nipple having a uniquely configured locking groove that will accept a corresponding valve having a corresponding dog so that a predetermined valve can only gain support at a predetermined landing nipple.

19. An assembly of a subterranean tool insertable into a landing nipple on a string, comprising:

at least one landing nipple at a subterranean location on the string;

at least one tool run in from a surface into said landing nipple for support thereof, said tool subsequently operable through said string or said landing nipple;

said tool comprises a barrier valve to isolate against flow in opposed directions;

said landing nipple comprises at least one connection with a line running to said connection from the surface;

said valve operably engages said connection when supported in said landing nipple;

said landing nipple rotationally orients said valve as said valve moves toward a supported position in said landing nipple so that said valve can engage said connection.

20. The assembly of claim 19, wherein:

said line comprises one of a tube, a wire and a fiber optic cable.

* * * * *